US007687694B2

(12) United States Patent
Clark et al.

(10) Patent No.: US 7,687,694 B2
(45) Date of Patent: Mar. 30, 2010

(54) LOW INERTIA GRAND PIANO PIANO ACTION

(75) Inventors: Bruce E. Clark, Nottingham, NH (US); Kevin Burke, Haverhill, MA (US); Kirk Burgett, Sacramento, CA (US)

(73) Assignee: Wessell, Nickel & Gross, Sacramento, CA (US)

( * ) Notice: Subject to any disclaimer, the term of this patent is extended or adjusted under 35 U.S.C. 154(b) by 0 days.

(21) Appl. No.: 11/964,148

(22) Filed: Dec. 26, 2007

(65) Prior Publication Data

US 2009/0007750 A1 Jan. 8, 2009

Related U.S. Application Data

(63) Continuation-in-part of application No. 11/762,990, filed on Jun. 14, 2007.

(51) Int. Cl.
*G10C 3/18* (2006.01)

(52) U.S. Cl. ..... 84/239; 84/236

(58) Field of Classification Search ..... 84/239, 84/236

See application file for complete search history.

(56) References Cited

U.S. PATENT DOCUMENTS 4,685,371 A 8/1987 Levinson
4,774,868 A 10/1988 Finholm
4,953,433 A 9/1990 Fandrich
4,995,291 A 2/1991 Takahashi
5,125,309 A 6/1992 Stanwood
6,509,517 B1 1/2003 Wroblewski
6,740,801 B2 * 5/2004 Yoshisue et al. ..... 84/452 P
6,972,359 B2 12/2005 Overs
7,057,101 B2 6/2006 Ishida
7,141,728 B2 11/2006 Yoshisue
7,279,627 B2 10/2007 Tanaka
2004/0168562 A1 * 9/2004 Yoshisue et al. ..... 84/236

* cited by examiner

*Primary Examiner*—Jianchun Qin
(74) *Attorney, Agent, or Firm*—Craig A. Simmermon

(57) ABSTRACT

Composite or plastic molded articles used in a grand piano piano action. The articles make up a piano action with less dynamic mass which is, thus, more responsive to the piano player. In addition, the new action provides the extremely valuable collateral benefits of increased efficiency of manufacture and maintenance. Low inertia grand piano piano action comprises a repetition base with one or more of the following: an angled main beam, an angled balancier support beam, an integrated jack button stop, and a means to optionally connect a rest cushion assembly. Low inertia grand piano piano action may also comprise a heel with extremely low mass.

6 Claims, 6 Drawing Sheets

LOW INERTIA GRAND PIANO PIANO ACTION

CROSS-REFERENCE TO RELATED APPLICATIONS

The instant application is a continuation-in-part of U.S. application Ser. No. 11/762,990 entitled "Grand Piano Composite Piano Action", filed on Jun. 14, 2007, which is hereby incorporated by reference herein.

BACKGROUND OF THE INVENTION

1. Field of the Invention

This invention pertains to the piano actions of grand pianos and specifically to piano actions that "actuate" or cycle with a substantially smaller energy requirement than other grand piano piano actions.

2. Description of Related Art

Pianists feel improvement in a piano action when the energy requirement to actuate or cycle the action in a particular way is reduced. This is because the work required by pianists' fingers to cycle the action in a particular way is reduced, thereby making the piano more comfortable to play. Reductions in energy requirements to actuate piano actions allow pianists to play music with less finger strength which improves finger control. Thus, the pianist can play in a more virtuoso fashion more easily and the pianist's playing abilities are thereby improved by the new piano action. Accordingly, there is a need for a grand piano piano action that cycles in a particular way from less finger work.

The cycling of a grand piano piano action primarily occurs through rotational motion of action members, causing a hammer to strike piano strings, thereby making piano music. The finger energy requirement to actuate a grand piano piano action is directly proportional to the change in angular momentum of the members of the action system.

Grand piano piano actions consist primarily of: a repetition base, a jack, a balancier, a heel, and a set of two regulating buttons. The repetition base is the largest and heaviest of the grand piano piano action components and also incurs the largest change in inertia or momentum during cycling of the piano action. Thus, the repetition base plays a significant role in the energy requirements to actuate a piano action. Accordingly, there is a need for a repetition base for a grand piano action that incurs less momentum change during the actuation cycle of the piano action.

The heel also incurs a relatively large momentum change during cycling of the action. Accordingly, there is a need for a heel for a grand piano action that incurs less momentum change during the actuation cycle of the piano action.

BRIEF SUMMARY OF THE INVENTION

It is an aspect of this invention to yield a grand piano action that actuates with significantly less energy requirements. As stated in the parent application, this improvement is achieved by redesign of action components using moment analysis as the main factor affecting design rather than mass and rigidity as the key design factors.

It is an aspect of this invention to provide a low inertia repetition base of a grand piano piano action with a main beam and a balancier support beam that are connected at an acute angle where the balancier support beam is angled towards the jack end of the main beam.

It is an aspect of this invention to provide a low inertia repetition base of a grand piano piano action with an integrated jack regulating button stop that stands essentially planar with the longitudinal axes of said main beam and said balancier support beam, and is integrated into the structure of said main beam.

It is an aspect of this invention to provide a low inertia repetition base of a grand piano piano action with a balancier regulating button stop that is adjacent to or contiguous with one end of the balancier support beam of the repetition base.

It is an aspect of this invention to provide a low inertia repetition base of a grand piano piano action with a main beam that includes a main beam angled section where this section has a longitudinal axis that essentially coincides with a hypothetical line between the repetition base center of rotation hinge pin hole and center point-of-contact between the heel and the repetition base.

It is an aspect of this invention to provide a range of low profile lightweight heels with various heights to function in tandem with the preceding aspect in order to greatly reduce the overall angular momentum change of the piano action during an action cycle.

It is an aspect of this invention to provide the option of attaching a rest cushion assembly to the grand piano piano action in order to accommodate grand piano brands requiring such.

DEFINITION LIST

| Term | Definition |
|---|---|
| 10 | Grand Piano Piano Action |
| 20 | Capstan contact point |
| 30 | Repetition center of rotation hinge pin hole |
| 40 | Repetition Base for Grand Piano |
| 43 | Hole for "Helper Springs" |
| 46 | Stop for the Jack Regulating Button |
| 50 | Rest Cushion |
| 60 | Rest Cushion Bracket |
| 70 | Repetition Rest Cushion Bracket Assembly (RBA) |
| 80 | RBA Center of Mass |
| 90 | RBA Effective Radius |
| 93 | Balancier Attachment Hinge Pin Hole |
| 96 | Jack Attachment Hinge Pin Hole |
| 100 | Repetition Rest Cushion Bracket Heel Assembly (RBHA) |
| 110 | RBHA Center of Mass |
| 120 | RBHA Effective Radius |
| 130 | Jack |
| 140 | Heel |
| 150 | Balancier |
| 160 | Balancier Regulating Button |
| 170 | Jack Regulating Button |
| 180 | Repetition Main Beam |
| 190 | Balancier Support Beam |
| 200 | Balancier Regulating Button Stop |

-continued

| Term | Definition |
|---|---|
| 210 | "V" Connection with Web Support |
| 220 | Main Beam/Balancier Support Beam Connection Location |
| 225 | Prior Art "T" Connection |
| 230 | Prior Art Repetition Base |
| 235 | Main Beam - Balancier Support Beam Angle |
| 240 | Repetition Base Effective Length |
| 250 | "Main Beam/Balancier Support Beam Connection Location" to "Balancier Regulating Button Stop" Distance |
| 260 | Main Beam Angled Section |
| 270 | Hypothetical Line Between Repetition Base Center of Rotation and the Center of Contact Between the Heel and Repetition Base |
| 280 | Center of Contact Between the Heel and Repetition Base |

DETAILED DESCRIPTION OF THE INVENTION

Figure 1:
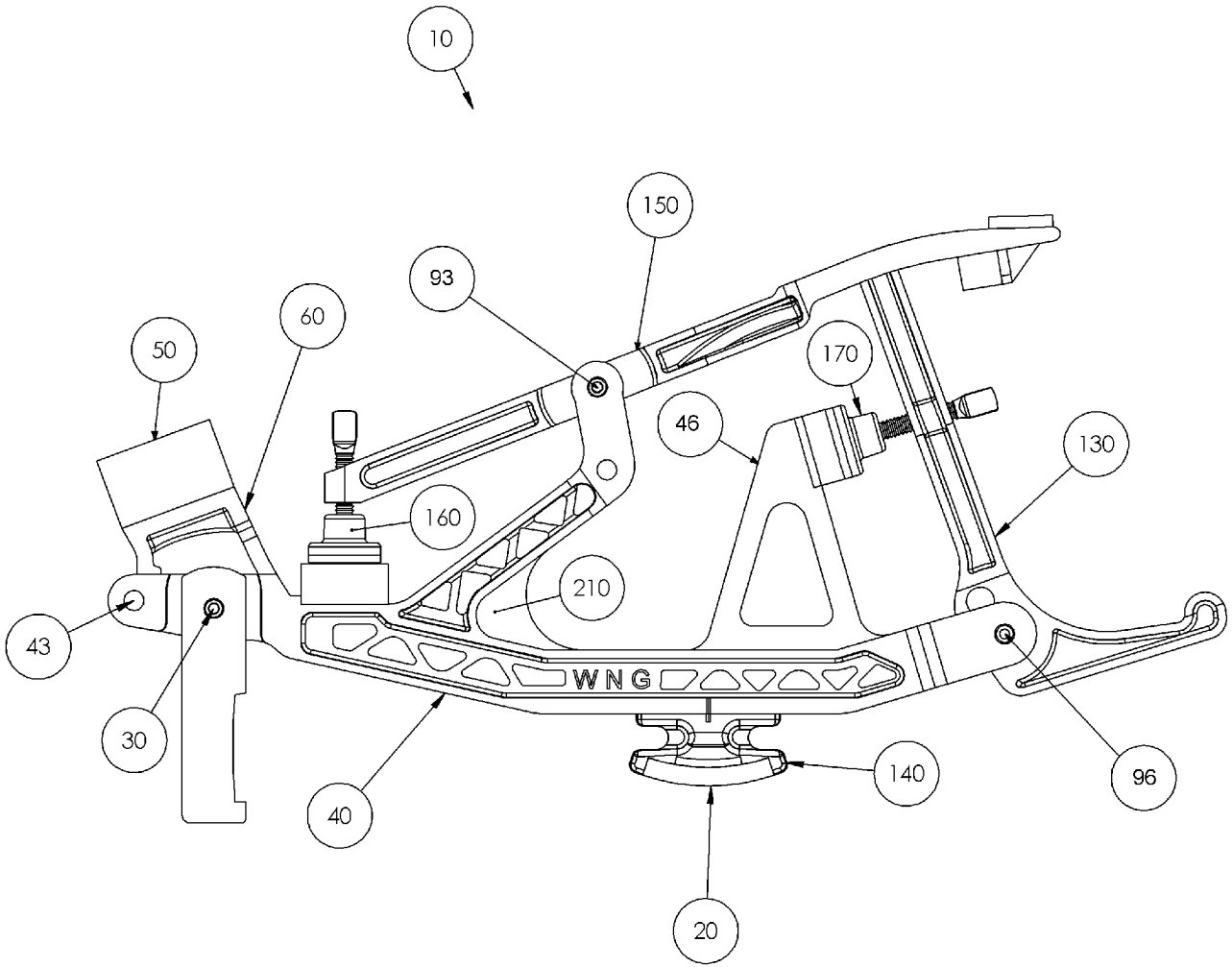
FIG. 1 is a front view of a grand piano piano action.

Grand piano piano action 10 is depicted in FIG. 1. Grand piano piano action 10 comprises: a repetition base 40, a jack 130, a balancier 150, a heel 20, a balancier regulating button 160, a jack regulating button 170, a stop for balancier regulating button 200, a stop for jack regulating button 46, and a rest cushion assembly (50 and 60). As stated in the parent application, these elements are essentially elements of traditional grand piano piano actions 10.

Figure 4:
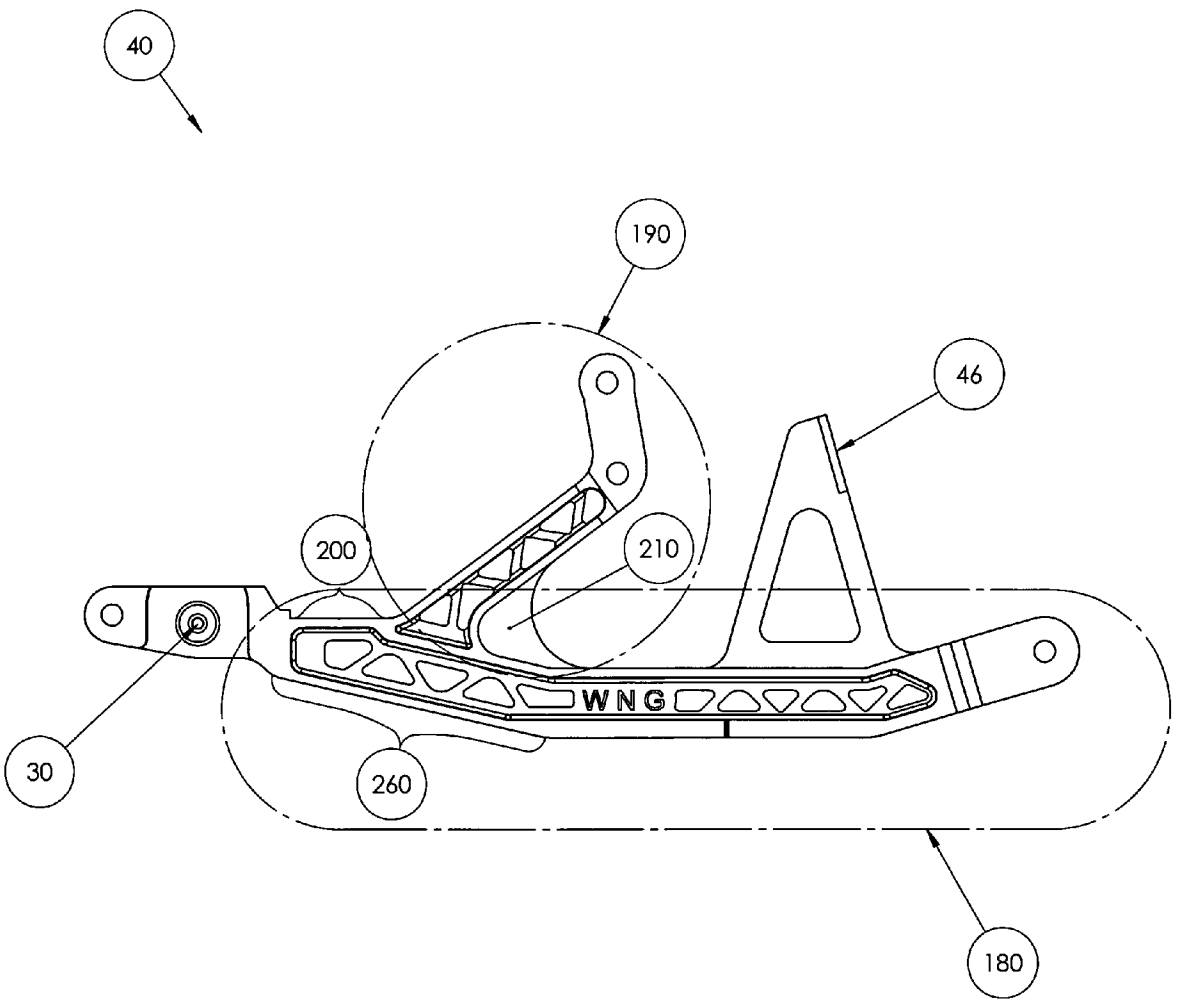
FIG. 4 is a front view of a Repetition Base depicting the major elements of a repetition base.
Figure 6:
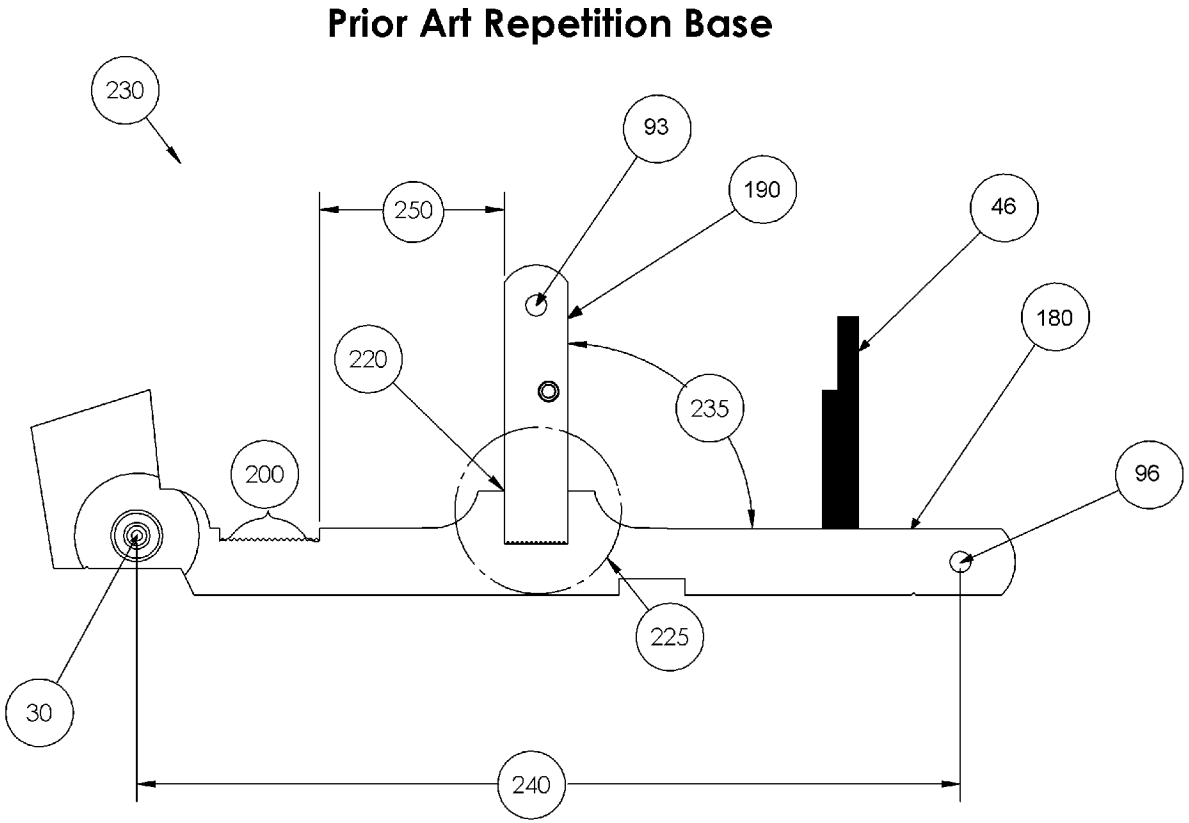
FIG. 6 depicts a Prior Art Repetition Base with common points of interest called out as related to the invention.

Prior art repetition base 230 is depicted in FIG. 6. Repetition base 40 of this invention is depicted in FIG. 4. Both comprise: a center of rotation hinge pin hole 30, a maim beam 180, a balancier support beam 190, a balancier attachment hinge pin hole 93, a stop for balancier regulating button 200, a stop for jack regulating button 46, and a jack attachment hinge pin hole 96. As with any traditional repetition base, the center of rotation hinge pin hole 30 is used to create a pivotal connection between the repetition base 40 and the repetition flange where such connection is accomplished by a hinge pin placed through hole 30. The main beam 180 supports the balancier support beam 190 and the stop for jack regulating button 46 above main beam 180. Stop for balancier regulating button 200 is located on the upper surface of main beam 180. With prior art repetition base 230, the jack regulating button stop 46 consists of a metal spoon that is affixed to the main beam 180. Repetition base 40 incorporates stop element 46 into main beam 180 as an integral unit to reduce weight of the repetition base 40 and reduce inertia of the action 10. Balancier support beam 190 supports a balancier 150 above main beam 180 where the balancier 150 is attached to support beam 190 with another pivotal connection accomplished by a hinge pin placed through hole 93. A jack 130 is attached with another pivotal connection accomplished by a hinge pin placed through hole 96.

Figure 2:
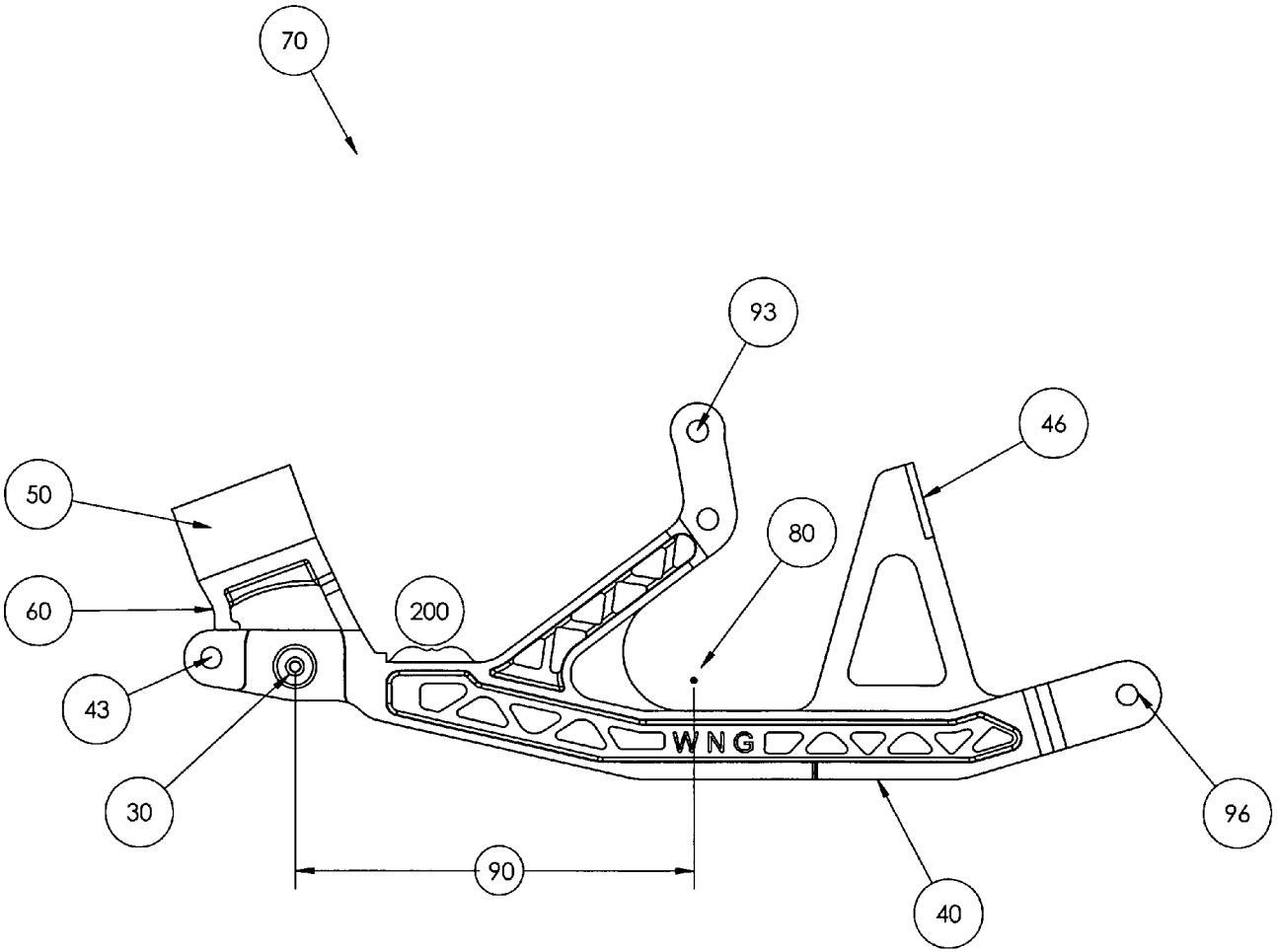
FIG. 2 is a front view of a Repetition Rest Cushion Bracket Assembly (RBA).

Repetition rest cushion bracket assembly 70 comprises: a repetition base 40, a rest cushion bracket 60, and rest cushion 50. Repetition rest cushion bracket assembly 70 is depicted in FIG. 2. Rest cushion bracket 60 supports the rest cushion 40 slightly above repetition base center of rotation hinge pin hole 30 to allow clearance for the rotation of repetition base 40 during the cycling of piano action 10. The rest cushion 50 is made of soft padding material, typically felt. Rest cushion 50 supports a hammer shank (not depicted) of an associated hammer (not depicted) when the piano key is at rest or upon release of the hammer by the back check, which occurs when a depressed piano key is released. Rest cushion 50 must catch the hammer shank without causing the hammer to bounce back up from the rest cushion 50. Rest cushion 50 is connected to repetition base 40 by the rest cushion bracket 60. Any known means may be used to connect these three elements together.

Some grand pianos require the rest cushion 50 to be attached to repetition base 40, while other grand piano designs require attachment of the rest cushion 50 to another part of the piano. Repetition bases 40 of this invention are interchangeable with both types of grand pianos because the rest cushion assembly (50 and 60) can be attached to the repetition base 40 or left off. Thus, repetition base 40 further comprises a rest cushion location and attachment means.

Figure 3:
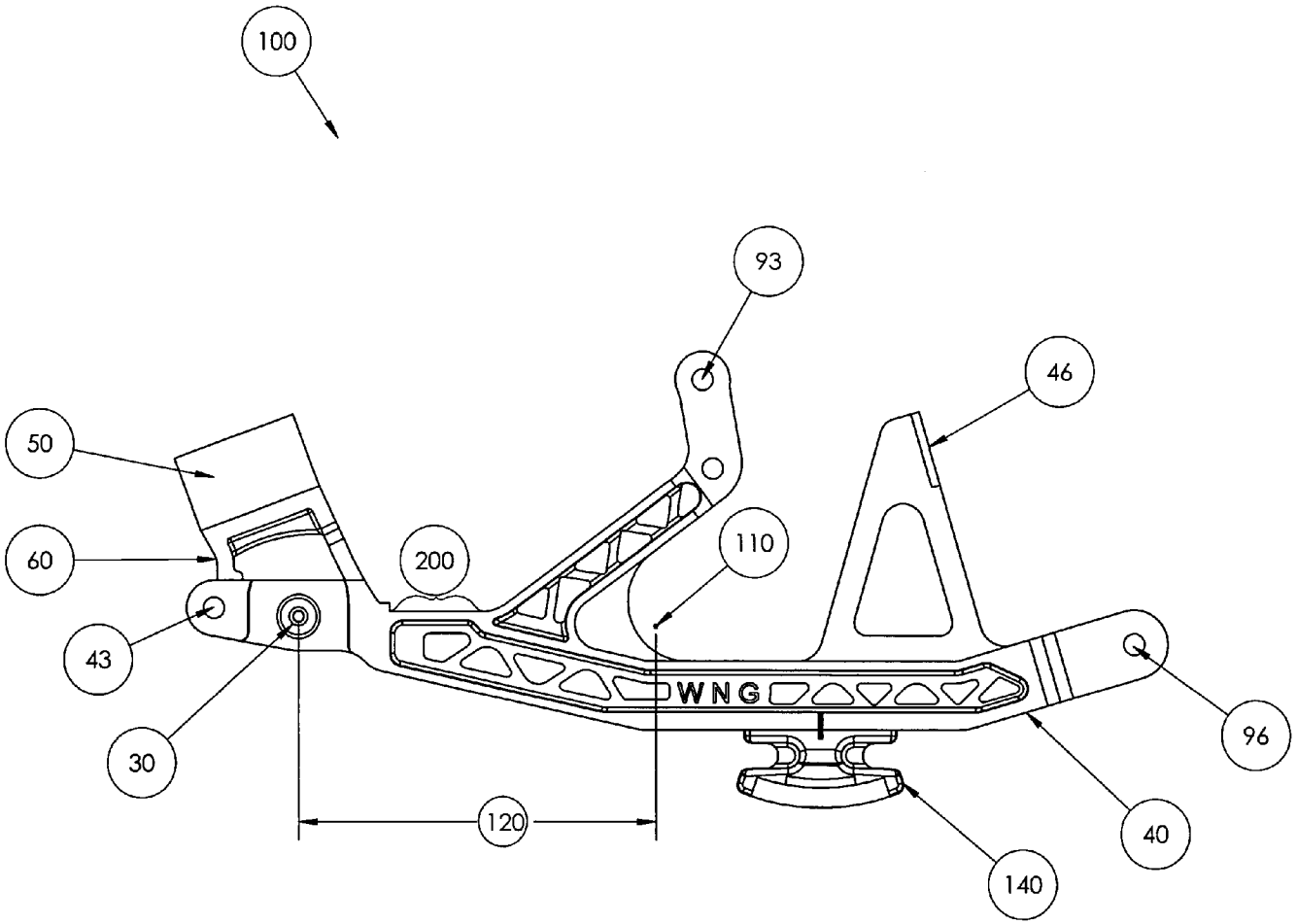
FIG. 3 is a front view of a Repetition Rest Cushion Bracket Heel Assembly (RBHA).

Rest cushion bracket heel assembly 100 comprises: a repetition rest cushion bracket assembly 70 and an attached heel 140. Rest cushion bracket heel assembly 100 is depicted in FIG. 3. Heel 140 provides primary support for the piano action 10 as heel 140 sits atop the capstan contact point 20 when the piano key and action 10 are at rest. Heel 140 is essentially a step member in the general shape of a rectangular prism, attached at its upper surface to the lower surface of said repetition base main beam. A capstan is fixed to each piano key. The piano action 10 is also supported at the repetition center of rotation 30. The repetition center of rotation 30 remains fixed as the piano action 10 cycles. The capstan contact 20 point moves primarily vertically upward and downward as the piano action cycles, i.e. piano key is depressed and released. It is this upward and downward motion that rotates the repetition base 40 around the repetition base center of rotation 30. The rotation of the repetition base 40 causes the hammer of the piano to strike the piano strings and retract there from.

An embodiment of this invention includes a repetition base 40 with repetition main beam 180 that is not straight, as with prior art repetition bases, but rather includes at least one angled section 260 that is angled toward the heel 140 of the action 10 and the capstan of the piano key. As shown in FIG. 6, prior art repetition bases 40 do not have this angled section 260. A repetition base 40 with main beam angled section 260 results in a lower inertia piano action primarily because of two reasons.

First, a main beam 180 with angled section 260 that extends downward toward the heel 140 of the action allows for a much shorter heel 140. A shorter heel 140 is desirable because shorter heels weigh less than taller heels. Weights of heels 140 are very important to the moment of inertia of the piano action 10 because heels 140 are relatively heavy components of the action 10 that are located relatively far from the repetition center of rotation 30. A main beam 180 with angled section 260 allows for a substantial weight savings in the heel 140. For instance, a mode of heel 140, as depicted in the drawings in this application, weighs 61% less than most heels in the public domain. The main beam angled section 260 is a component of the repetition main beam 180.

Second, the "V" connection with web support 210 between the repetition main beam 180 and the balancier support beam 190 delivers much more rigidity than the prior art "T" connection 225 between analogous components of the repetition base. Thus, the increased rigidity of this design, allows for a reduction in material and mass of the repetition base 40 in the vicinity of area 225 without compromise to the overall rigidity requirement of the piano action 10.

Figure 5:
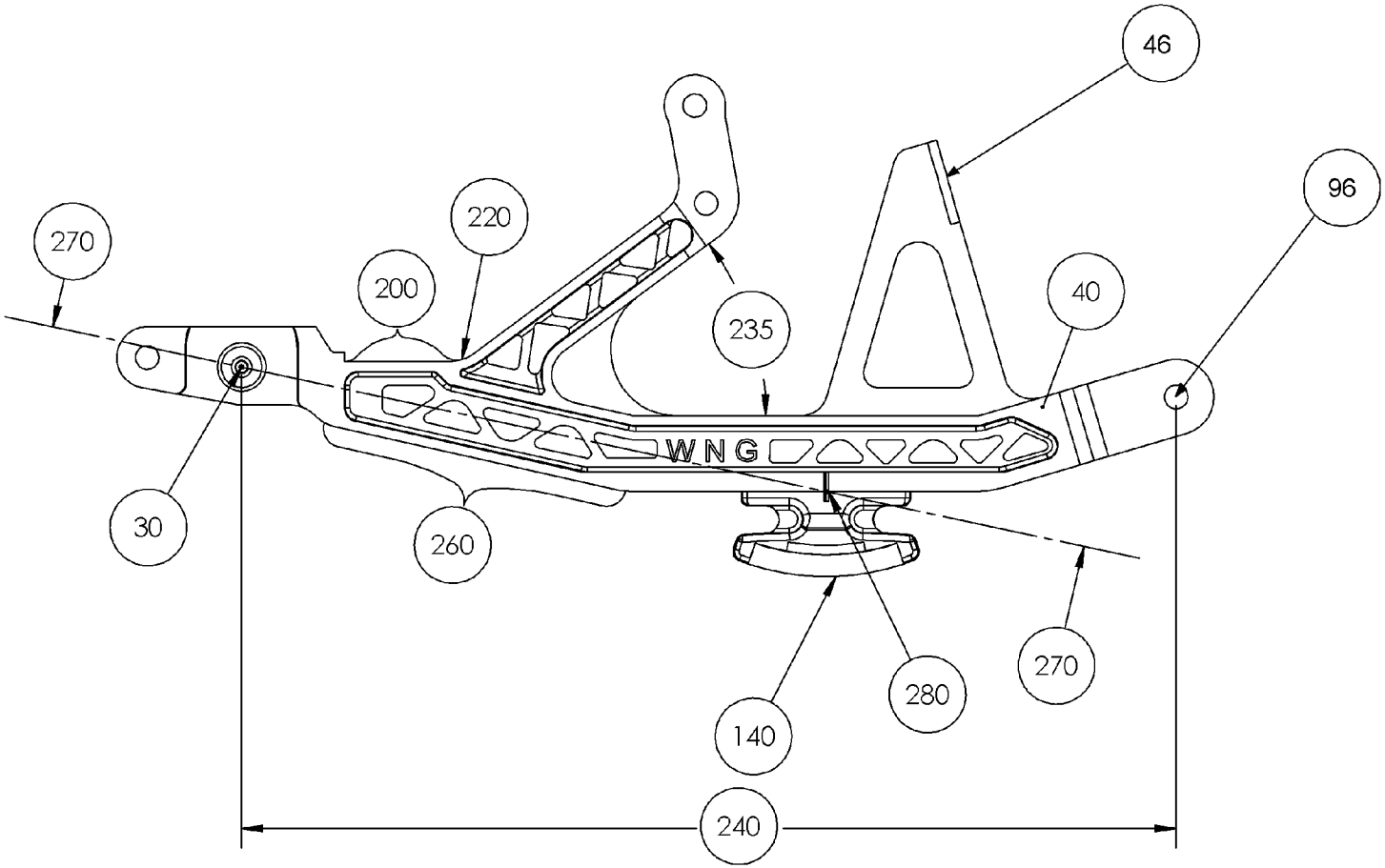
FIG. 5 describes the juxtaposition of the main beam angled section of a repetition base in relation to the whole repetition base.

An embodiment of the repetition base 40 includes a balancier support beam 190 that connects with the repetition main beam 180 at a connection location 220 that is essentially immediately adjacent to the balancier regulating button stop 200. Main beam/balancier support beam connection location 220 is a hypothetical location on the repetition base 40, introduced to help articulate description of the invention. Main beam/balancier support beam connection location 220 is defined as a point on the upper surface of the repetition base 40 that lies at the seem between the repetition main beam 180 and the balancier support beam 190. See FIG. 5 for a depiction of the location 220.

Prior art repetition bases have main beam/balancier support beam connection location 220 located relatively far from the balancier regulating button stop 200, typically by a distance 250 that is about 25% of the effective length of the repetition base 240. Repetition base effective length 240 is defined as the distance between repetition center of rotation 30 and jack attachment hinge pin hole 96. See FIG. 6 for a depiction of prior art repetition bases 40 with points 220 and 200 called out. The new design moves the center of mass of the repetition base 40 towards the repetition center of rotation 30, thus reducing the moment of inertia of the piano action 10, without sacrificing rigidity.

Repetition base 40 may also includes a novel connection angle 235 between the repetition main beam 180 and balancier support beam 190. This angle 235 has always been essentially 90 degrees. See FIG. 6 for a depiction of prior art. As a result of the scientific method described above aimed to move mass, reduce mass, and increase rigidity of the repetition base 40 in order to reduce touch weight of the action 10, we introduce a repetition base with an acute angle 235 as seen on FIG. 5 as the best mode. The best mode angle depicted here is within the breadth of claim 1.

The moment of inertia of a rigid body rotating about a fixed axis is $\int r^2 dm$, where r is the distance from center of rotation to the differential mass point of the body dm. The moment of inertia of a piano action component can be approximated by: (the distance from center of rotation to the center of mass)$^2\times$ (mass).

The moment of inertia of a repetition rest cushion bracket assembly (RBA) 70, can be accurately approximated using the distance from repetition center of rotation 30 to the RBA center of mass center of mass 80—hereafter know as the RBA effective radius 90—and the mass of the RBA 70. A mode of this invention has a moment of inertia equal to 17,456 gmm$^2$ from a RBA weight of 9.35 grams and RBA effective radius of 43.19 mm. This moment is a dramatic improvement over the prior art in that it is substantially less than that of prior art and thus yields a piano action 10 with greatly improved response.

The moment of inertia of a rest cushion bracket heel assembly (RBHA) 100, can be accurately approximated using the distance from repetition center of rotation 30 to the RBHA center of mass center of mass 110—hereafter know as the RBHA effective radius 120—and the mass of the RBHA 100. A mode of this invention has a moment of inertia equal to 20,861 gmm$^2$ from a RBHA weight of 10.31 grams and RBHA effective radius of 44.97 mm. This moment is a dramatic improvement over the prior art in that it is substantially less than that of prior art and thus yields a piano action 10 with greatly improved response.

What is claimed is:

1. A grand piano piano action comprising:
a repetition base;
a jack;
a balancier;
a heel;
a balancier regulating button; and
a jack regulating button; wherein,
said repetition base comprises: a main beam; a balancier support beam; a balancier regulating button stop; and an integrated jack regulating button stop; wherein,
said main beam is elongated with a center of rotation end and a jack end, with a hinge pin hole in each end,
said balancier support beam is elongated with a hinge pin hole in one end and is connected to said main beam at the other end, to form an acute angle connection (235) measuring 5-45 degrees, wherein said balancier support beam is angled towards said jack end of said main beam,
said integrated jack regulating button stop stands essentially planar with the longitudinal axes of said main beam and said balancier support beam, and is integrated into the structure of said main beam, and
said balancier regulating button stop is a flat area located on the upper surface of said center of rotation end of said main beam, and
said heel is essentially rectangular prism shaped and attached to the lower surface of said repetition base with its longitudinal axis parallel with that of said main beam.

2. A grand piano piano action as recited in claim 1, wherein one edge of said flat area of said balancier regulating button stop is contiguous with or directly adjacent to a connection location (220) defined as a seam on the upper surface of said repetition base at the location where the upper surface of said balancier support beam connects with the upper surface of said main beam.

3. A grand piano piano action as recited in claim 1, wherein said main beam is not straight, but further comprises at least one a main beam angled section (260).

4. A grand piano piano action as recited in claim 3, wherein said main beam angled section (260) has longitudinal axis that essentially coincides with a hypothetical line (270) between the repetition base center of rotation hinge pin hole (30) and center point-of-contact between said heel and said repetition base (280).

5. A grand piano piano action as recited in claim 4, wherein said heel weighs 0.75-1.75 grams.

6. A grand piano piano action as recited in any one of the preceding claims further comprising:
a rest cushion bracket; and
a rest cushion; wherein,
said rest cushion bracket is affixed to the top of said repetition base main beam at the center of rotation end and is a means to hold said rest cushion slightly above the repetition base center of rotation hinge pin hole, and
said rest cushion is a padded member attached to the top of said rest cushion bracket and functions to catch without rebound a hammer shank during the cycle of said grand piano piano action.

* * * * *